United States Patent [19]

Casey

[11] Patent Number: 4,682,400

[45] Date of Patent: Jul. 28, 1987

[54] TERMINATING APPARATUS

[75] Inventor: Daniel T. Casey, Harrisburg, Pa.

[73] Assignee: AMP Incorporated, Harrisburg, Pa.

[21] Appl. No.: 795,036

[22] Filed: Nov. 4, 1985

[51] Int. Cl.[4] ..... H01R 43/04

[52] U.S. Cl. ..... 29/564.7; 29/566.3

[58] Field of Search ..... 29/566.3, 566.2, 564.2, 29/564.7, 564.8, 748, 753, 33 M

[56] References Cited

U.S. PATENT DOCUMENTS

| | | | |
|---|---|---|---|
| 3,659,328 | 5/1972 | Klein | 29/566.2 X |
| 3,953,916 | 5/1976 | Rolland et al. | 29/566.3 |
| 4,099,316 | 7/1978 | Morgan et al. | 29/566.2 |
| 4,271,581 | 6/1981 | Eitzinger | 29/564.6 |
| 4,335,497 | 6/1982 | Casey | 29/748 X |
| 4,464,817 | 8/1984 | Johnson, Jr. et al. | 29/564.8 X |

FOREIGN PATENT DOCUMENTS

| | | | |
|---|---|---|---|
| 230693 | 12/1985 | German Democratic Rep. | 29/566.2 |

*Primary Examiner*—William R. Briggs

*Attorney, Agent, or Firm*—F. Brice Faller; Adrian J. LaRue; David L. Smith

[57] ABSTRACT

Apparatus for mass terminating discrete wires to a connector preloaded with terminals connected to a carrier strip comprises a press having a vertically movable upper tooling package aligned above a termination station and a lower tooling package movable to and from the termination station. The lower package includes a housing support, a carrier shear, and a wire shear bar which moves over the support by action of a camtrack as the lower tooling moves to the station. Descent of the upper tooling shears the wires and the carrier, then terminates the wires as it moves a terminal loader above the carrier shear into vertical alignment with the terminals. A detent holds the vertical alignment as a cam track advances the loader toward the connector to fully load the terminals in the connector as the lower package moves from the station.

11 Claims, 19 Drawing Figures

99
90
102
57
56
67
60
50
97
62
25
32
27
119
110
111
116
118
107
122
106
108

TERMINATING APPARATUS

BACKGROUND OF THE INVENTION

The present invention relates to apparatus for mass terminating and loading terminals in a connector having strip form terminals preloaded therein.

U.S. Pat. No. 4,335,497 discloses apparatus for mass terminating conductors to an electrical connector of the type comprising a housing preloaded with a plurality of terminals connected to a carrier strip, each terminal having a conductor receiving portion exposed from the housing. The apparatus is of the type comprising a press having a vertically movable upper tooling package aligned above a termination station, housing support means and anvil means movable on a linear path to and from the termination station, and a shear cooperable with the anvil means to shear the carrier strip on descent of the upper tooling package. The anvil means supports the exposed conductor receiving portions of the terminals.

The above described apparatus does not incorporate any means for loading the terminals into the housing after termination and it is only adapted for use with pre-cut ribbon cable placed endwise over the exposed terminals.

SUMMARY OF THE INVENTION

The present invention is characterized in that the shear, the housing support, and the anvil are part of a lower tooling package movable as a unit to and from the termination station. The lower tooling package further comprises terminal loading means above the shear, which means is aligned with the terminals by descent of the ram. The apparatus further comprises means for moving the terminal loading means toward the housing support means to load the terminals into the housing during movement of the lower tooling package from the termination station.

According to a further aspect of the invention, comb means are provided in the lower tooling package, which means maintain continuous lengths of wire in alignment directly over the terminals. A conductor shear bar in the lower tooling package cooperates with the upper tooling package to shear the wires adjacent the conductor receiving portions of the terminals on descent of the ram. The shear bar is advanced to a position over the housing support for shearing during movement of the lower tooling package to the termination station, and retreats during movement from the termination station to permit removing a completed assembly.

The inventive apparatus thus not only loads the terminals after termination and shearing the carrier strip, but permits assembly of connectors terminated with discrete wire drawn from reels. The apparatus is operated simply by moving the lower tooling package to the terminating station, actuating the press, and moving package from the station.

DETAILED DESCRIPTION OF THE PREFERRED EMBODIMENT

Figure 1:
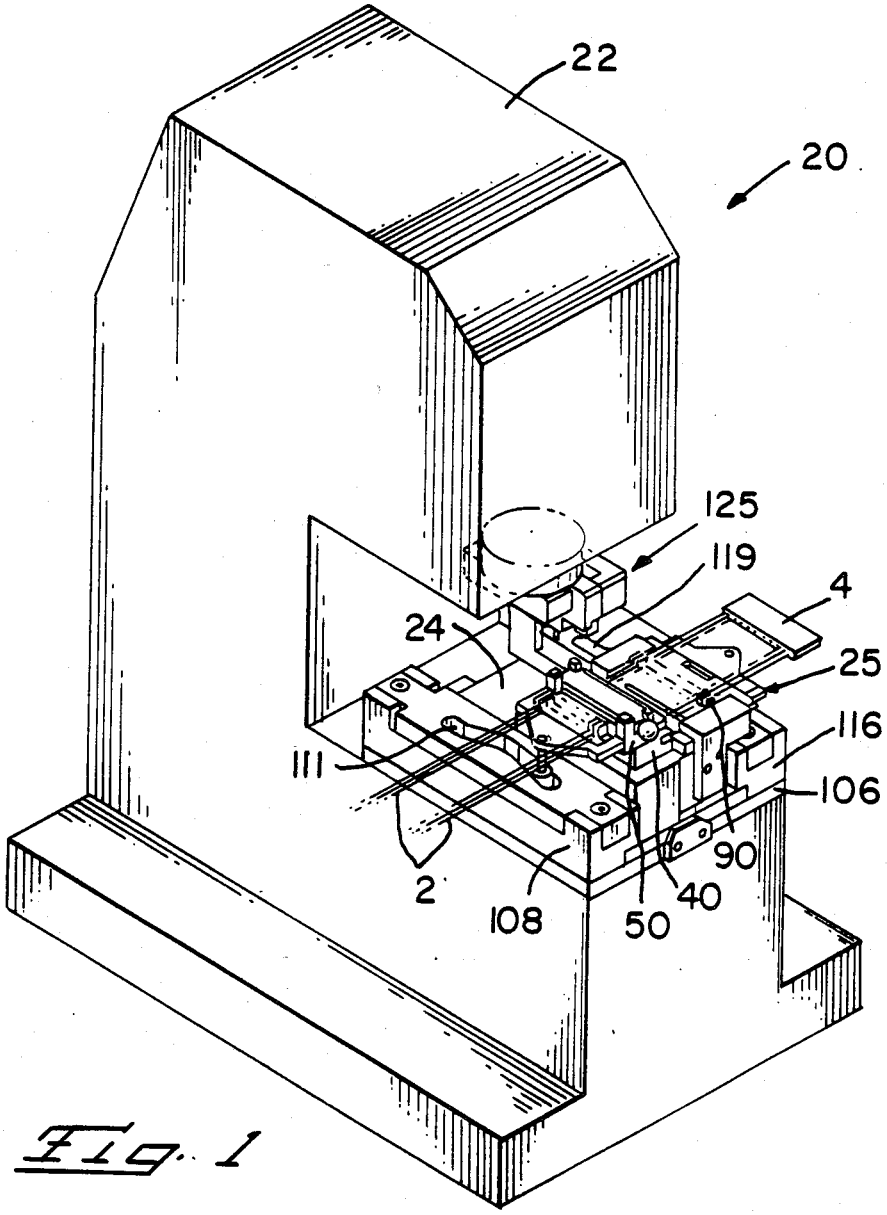
FIG. 1 is a perspective of the apparatus.

FIG. 1 shows the apparatus 20 which includes a standard bench press 22 having a vertically actuable ram with an upper tooling package 125 thereon over a termination station 24. A lower tooling package 25 is movable to and from the termination station on a platen 106 between left and right guides 108, 116. During movement to the station 24, shear bar 90 is moved inward by right cam track 119 so that it can cooperate with upper tooling 125 to shear wires 2 during insertion. The tooling 125 also urges terminal loader 50 and carrier shear 40 downward; the loader 50 is moved inward by left cam track 111 as the tooling 25 is returned from station 24. The loaded housing 4 then pops up and can be drawn rightward to the position shown.

Figure 2A:
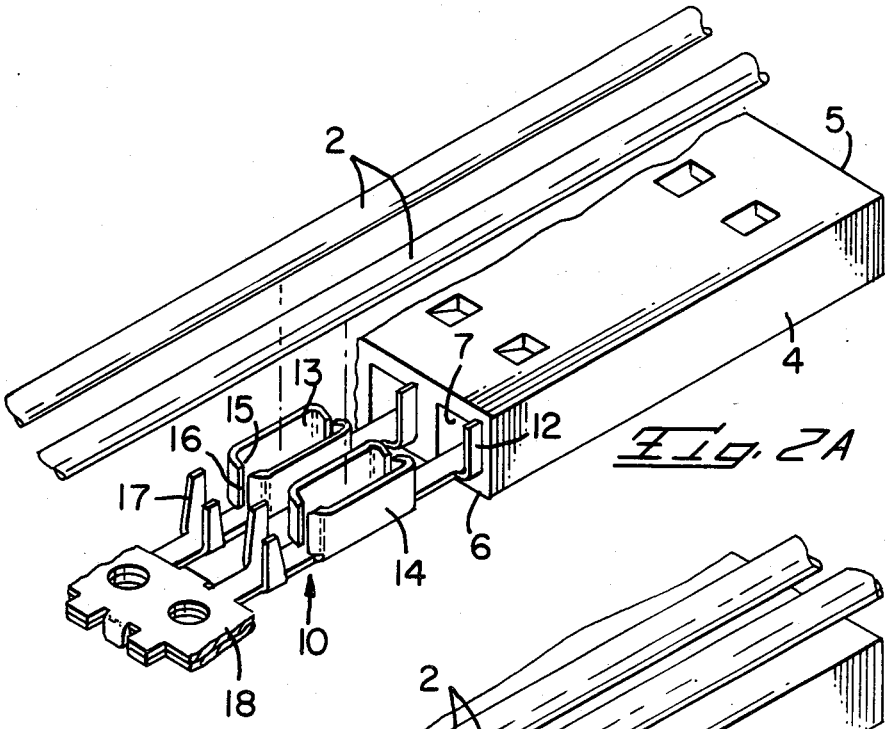
FIG. 2A–2C are schematic views of the operative steps on the connector.

Referring to FIG. 2A, the connector housing 4 has a mating face 5, an opposed terminal receiving face 6, and terminal passages 7 therebetween. Terminals 10 of the general type described in U.S. Pat. No. 4,385,794 each have a conductor receiving portion 13 formed by a pair of sidewalls 14 with end flaps 15 defining insulation displacing slots 16 for wires 2. The terminals 10 are "preloaded" in respective passages 7 while still attached to carrier strip 18. The strip 18 is a stacked assembly of the type described in U.S. Pat. No. 4,021,095, which permits close enough centerline spacing for automated preloading. Upstanding tines 12 prevent fully loading the terminals and serve to positively position the portions 13 relative to housing 4.

Figure 2B:
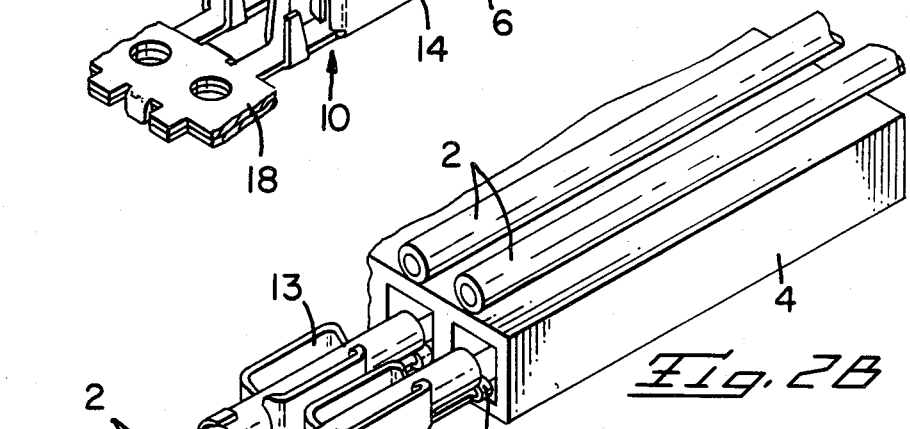
Figure 2C:
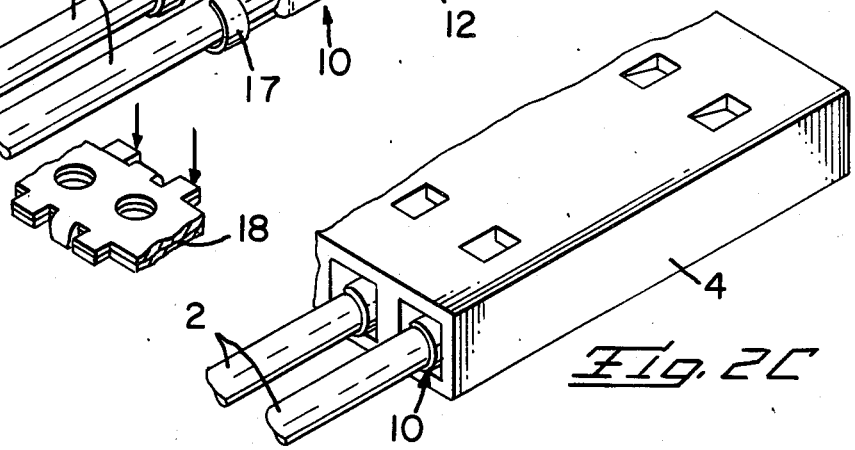

FIG. 2B shows the terminals 10 after the upper tooling 125 (FIG. 1) has been cycled; this operation serves to crimp the tines 12, shear the carrier strip 18, shear the wires 2, stuff the wires into conductor receiving portion 13, and form the insulation gripping tines 17. After the tooling 125 returns upward, the lower tooling 25 (FIG. 1) is returned, causing the terminals 10 to be fully inserted as shown in FIG. 2C.

Figure 3:
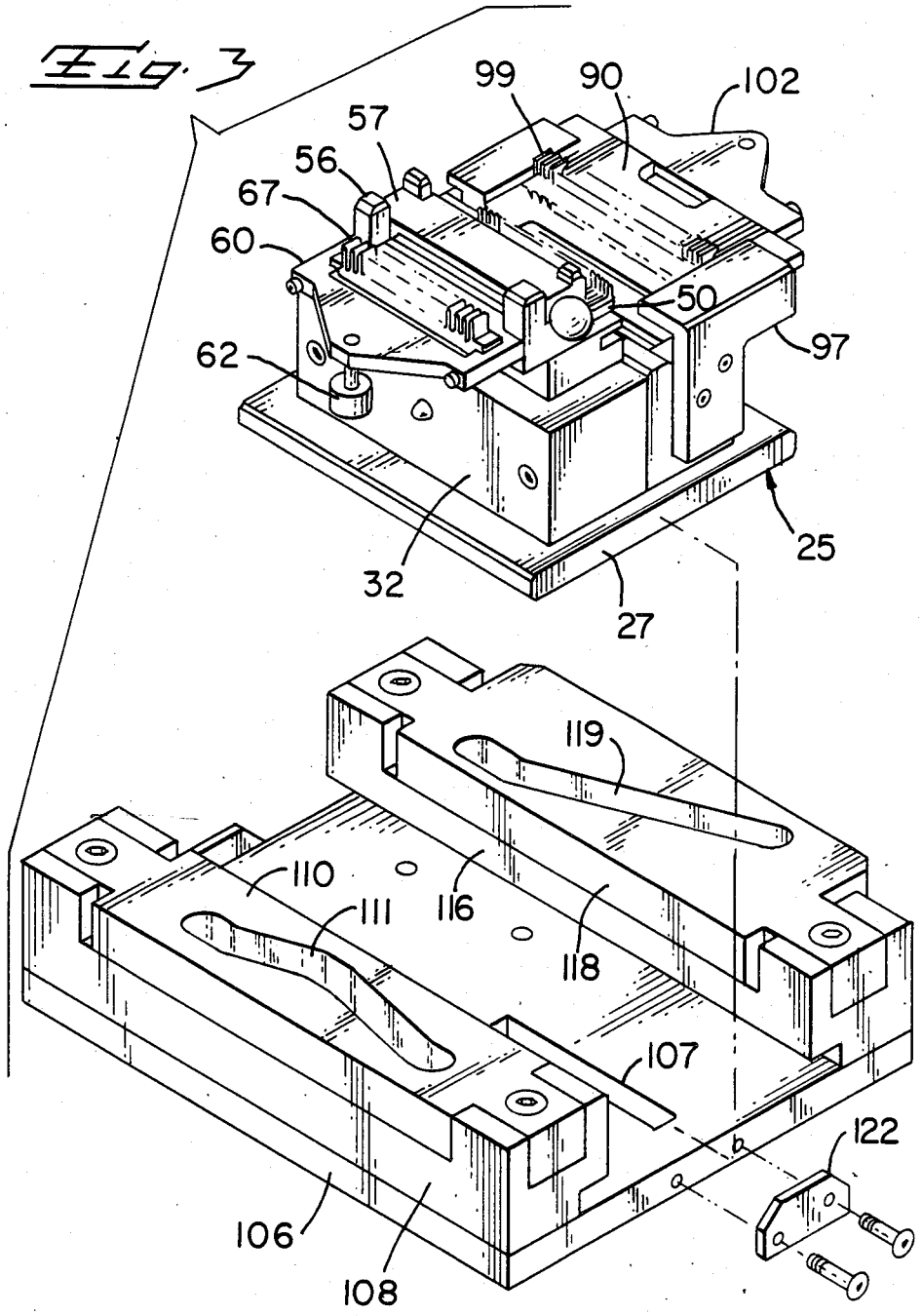
FIG. 3 is a perspective of the lower tooling package and the platen.
Figure 4:
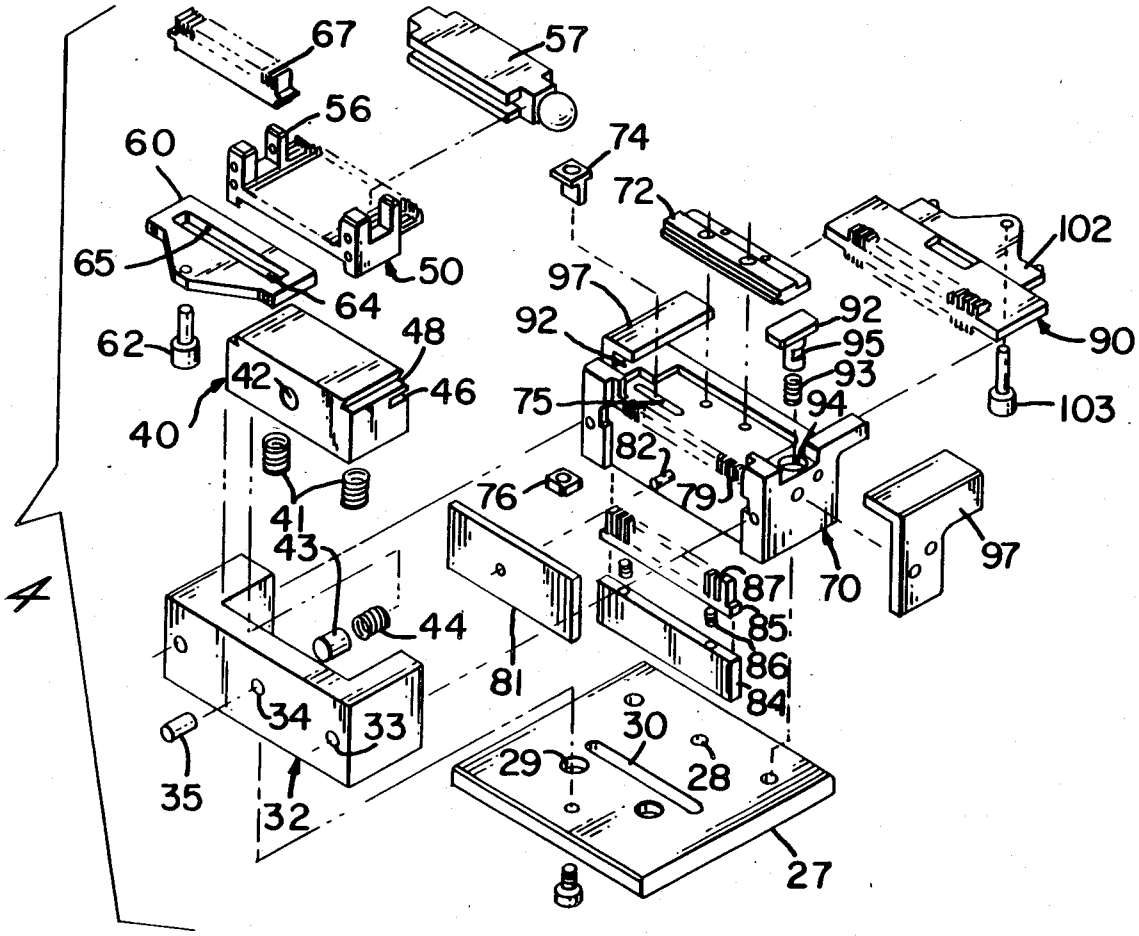
FIG. 4 is an exploded perspective of the lower tooling package and the platen.
Figure 4A:
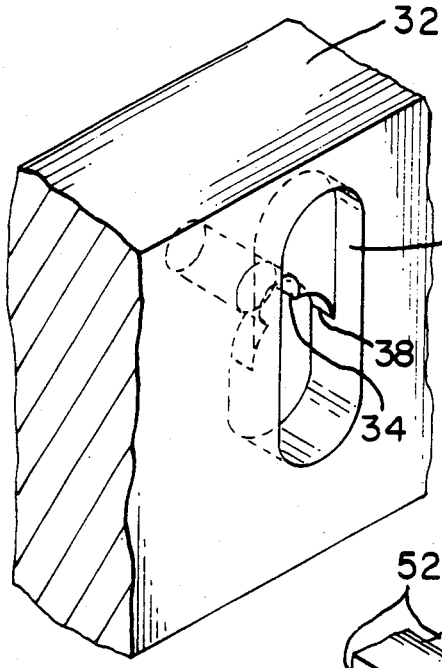
FIG. 4A is an inside perspective of the carrier shear guide.
Figure 4B:
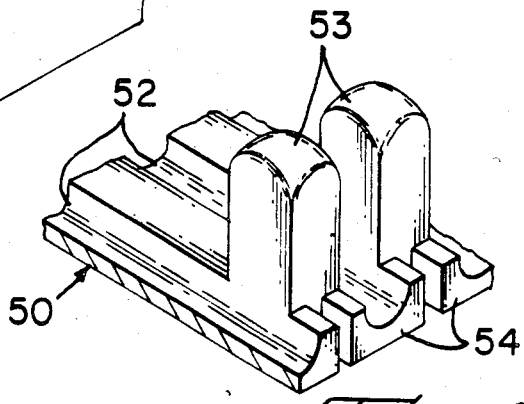
FIG. 4B is a partial perspective of the loader.

Referring to FIGS. 3 and 4, the lower tooling package 25 includes a base plate 27 having bolt holes 28 for fixing carrier shear guide 32 and housing support 70 thereto. Spring pockets 29 receive springs 41 which load carrier shear 40 upward in guide 32, and slot 30 is a scrap chute for the severed carrier 18 (FIG. 2A). A bore 34 in guide 32 receives release pin 35, which acts on detent 43 loaded in pocket 42 against spring 44. Referring to FIG. 4A, the inside face of guide 32 is profiled with a shallow slot 36 and a retention pocket 38, which will be further described in conjunction with FIGS. 10 and 12.

the carrier shear 40 is profiled with dovetail grooves 48 which receive the terminal loader 50 for sliding movement. An outrigger 60 fixed to the loader 50 carries a follower 62 which rides in cam track 111, and also has an aperture 64 with ball plungers 65 to retain snap-in wire comb 67. Referring also to FIG. 4B, the comb 67 aligns wires with channels 52 extending between comb teeth 53 to end surfaces 54 on the loader 50. Wires are held in place (FIG. 1) by a clamp 57 pivoted between stanchions 56.

Figure 4D:
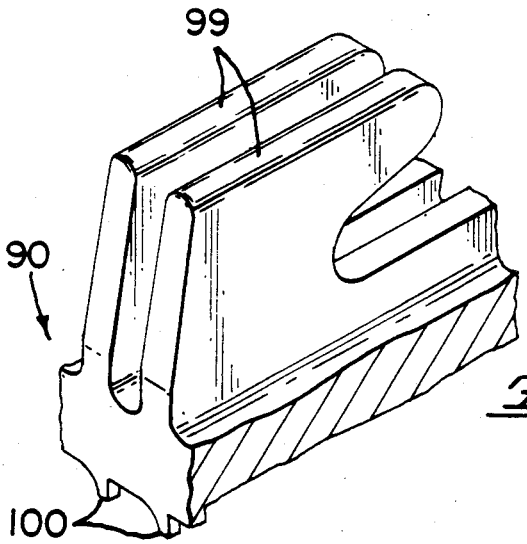
FIG. 4D is a partial perspective of the shear bar.
Figure 4C:
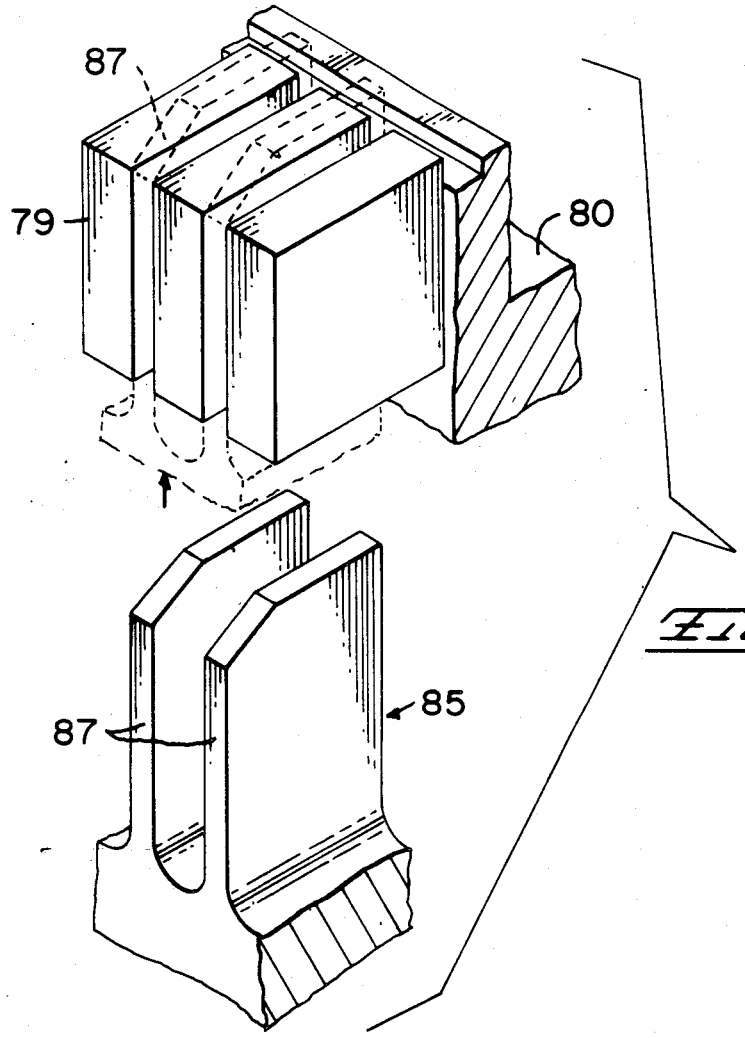
FIG. 4C is a perspective of the contact organizer and terminal support.
Figure 4E:
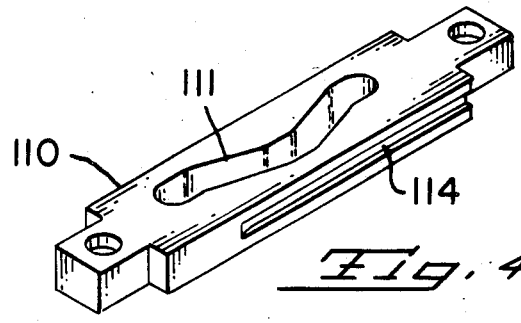
FIG. 4E is an inside perspective of the left guide cam.

The housing support 70 has a support rail 72 bolted thereto in one of two orientations, depending on the height of the connector. A T-shaped side stop 74 received in slot 75 and held fast by nut 76 serves to position the connector laterally, while the exposed terminals are supported on anvil means comprising a slotted support portion 79 and a carrier shear 81 having coplanar top surfaces. A platform 84 is sandwiched between housing support 70 and carrier shear 81, which is positioned by pin 82. Referring also to FIG. 4C, a contact organizer 85 is loaded upward by springs 86 so that partitions 87 extend through the slotted support 79 to provide lateral support for the conductor receiving portions of the terminals during termination. The terminal support 79 also has a ledge 80 which supports the edge of the housing 4 at face 6 (FIG. 2A).

The shear bar 90 is received between pedestals 92 and top rails 97 fixed to the support 70. The pedestals 92 ride on springs 93 in pockets 94 to load the bar 90 upward. Screw means received through rails 97 and support 70 extend into channels 95 on the pedestals 92 to limit upward travel. An outrigger 102 fixed to bar 90 carries follower 103 which rides in track 119 to effect horizontal movement of the bar over the support 70. Referring also to FIG. 4D, the bar 90 has comb teeth 99 which align wires therebetween, and die surfaces 100 on the underside of the leading edge which are profiled to form the tines 12 (FIG. 2A).

Referring now just to FIG. 3, the base plate 27 is received between left and right guides 108, 116 fixed to platen 106, which is in turn fixed to the press 22 (FIG. 1). The guides 108, 116 have respective left and right cam blocks 110, 118 fixed thereto, which in turn are profiled with respective left and right cam tracks 111, 119. Movement of the lower tooling package 25 between guides 108, 116 on a first linear path thus effects transverse movement on loader 50 and shear bar 90 by virtue of followers 62, 103 riding in respective tracks 111, 119. Slot 107 serves as a scrap chute, and stop 122 limits movement of the lower tooling.

Figure 5:
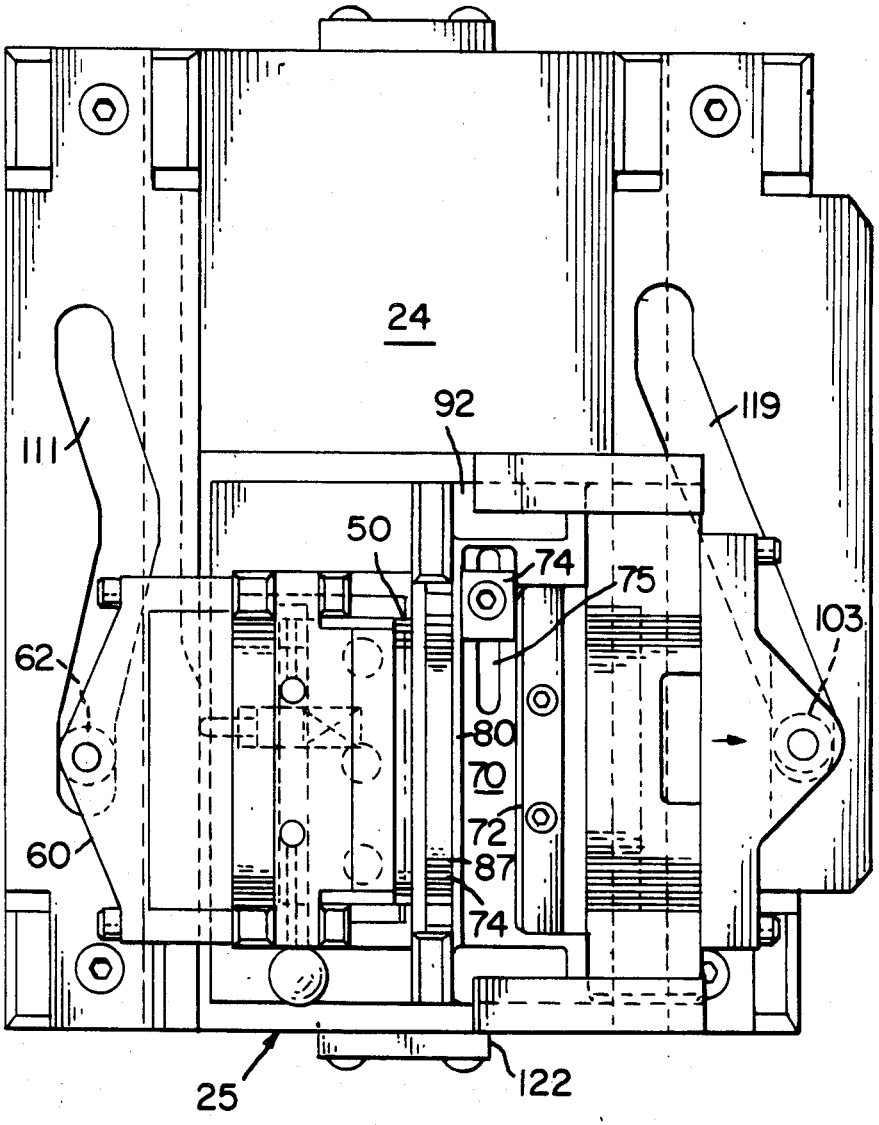
FIG. 5 is a plan view of the lower tooling remote from the termination station.

FIG. 5 depicts the lower tooling 25 against stop 22 remote from termination station 24, the shear bar 90 being retracted to expose the housing support 70 so it can receive a housing 4 (FIG. 2A) on rear rail 72 and ledge 80. Lateral positioning is accomplished by adjustably locating stop 74 in slot 75. Terminals 10 are aligned between partitions 87 on support 79, and thereafter wires are threaded through first comb teeth 53 and second comb teeth 99 to align the wires with terminals therebelow. The snap-in comb 67 (FIG. 4) may be assembled to the wires remotely and then placed in aperture 64 in outrigger 60. The tooling is then moved toward the terminating station, which is done manually, although a pneumatic cylinder could readily be installed. Note that this movement will cause the loader 50 to move inward and back, but it is too high to affect the connector.

Figure 6:
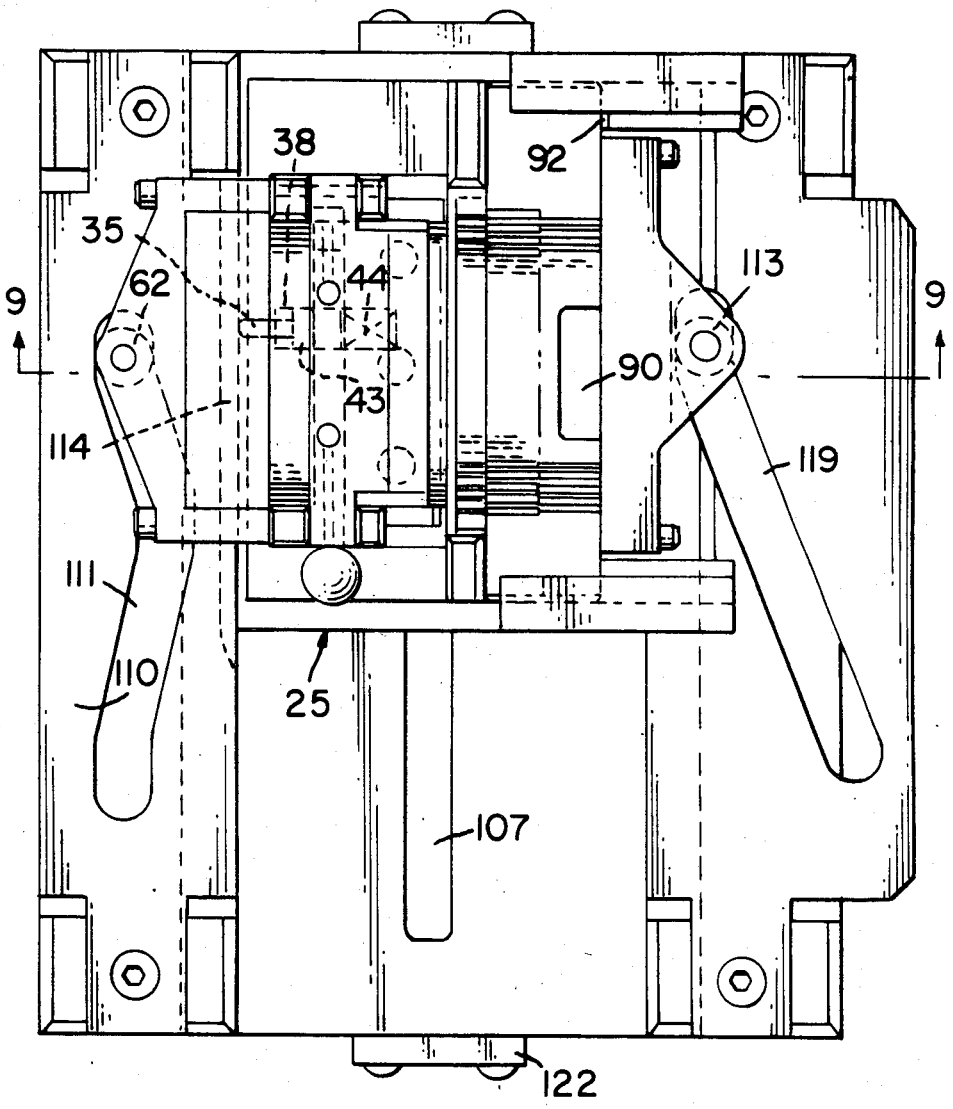
FIG. 6 is a plan view of the lower tooling at the termination station.
Figure 10:
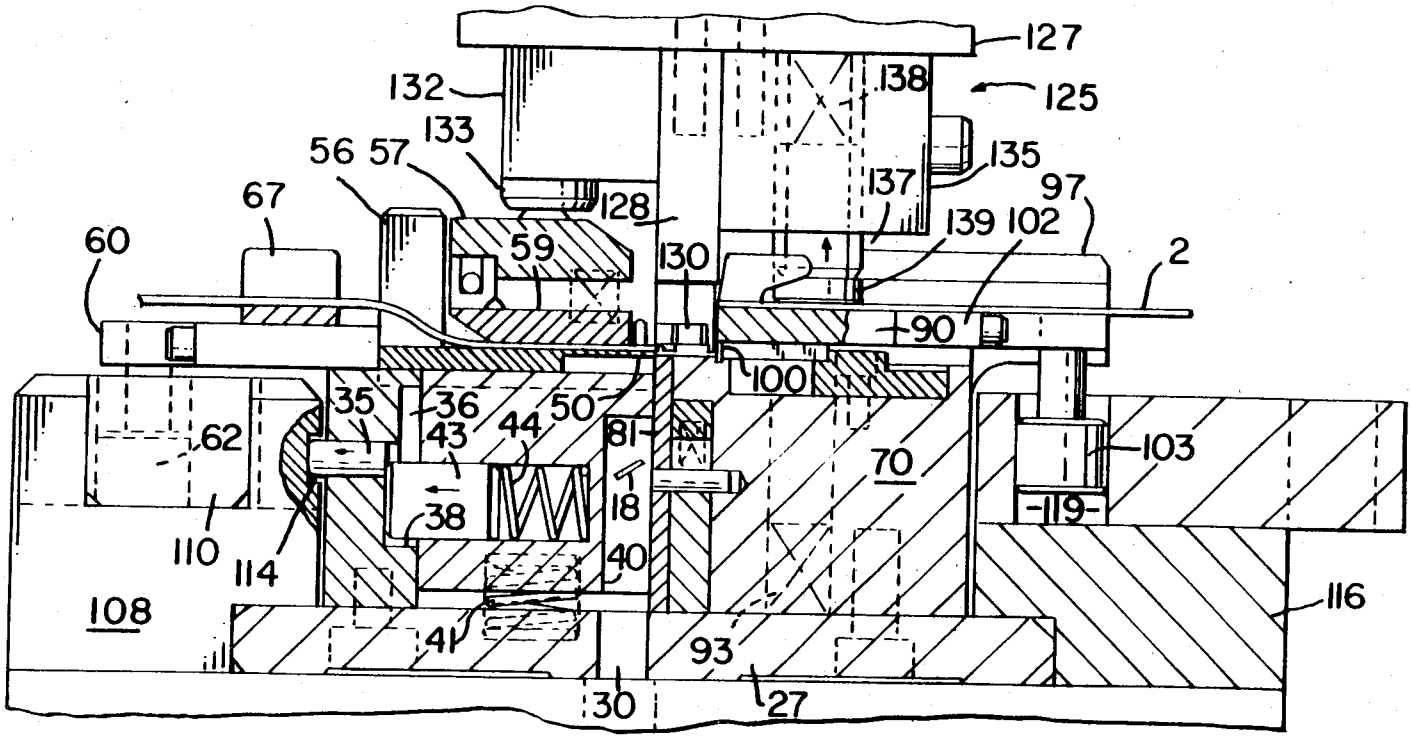

FIG. 6 shows the lower tooling 25 at the terminating station; here the shear bar 90 has moved inward over housing support 70, resting on pedestals 92 so that downward movement is possible. Detent release pin 35 has not entered channnel 114 in left cam block 110, because the detent 43 cannot enter pocket 38 until the upper tooling has descended (FIG. 10). The lower tooling 25 will remain at the terminating station until the upper tooling has been cycled.

Figure 7:
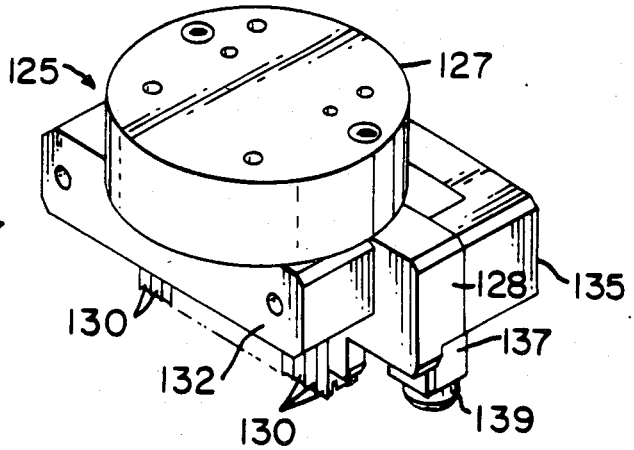
FIG. 7 is a perspective of the upper tooling package.
Figure 8:
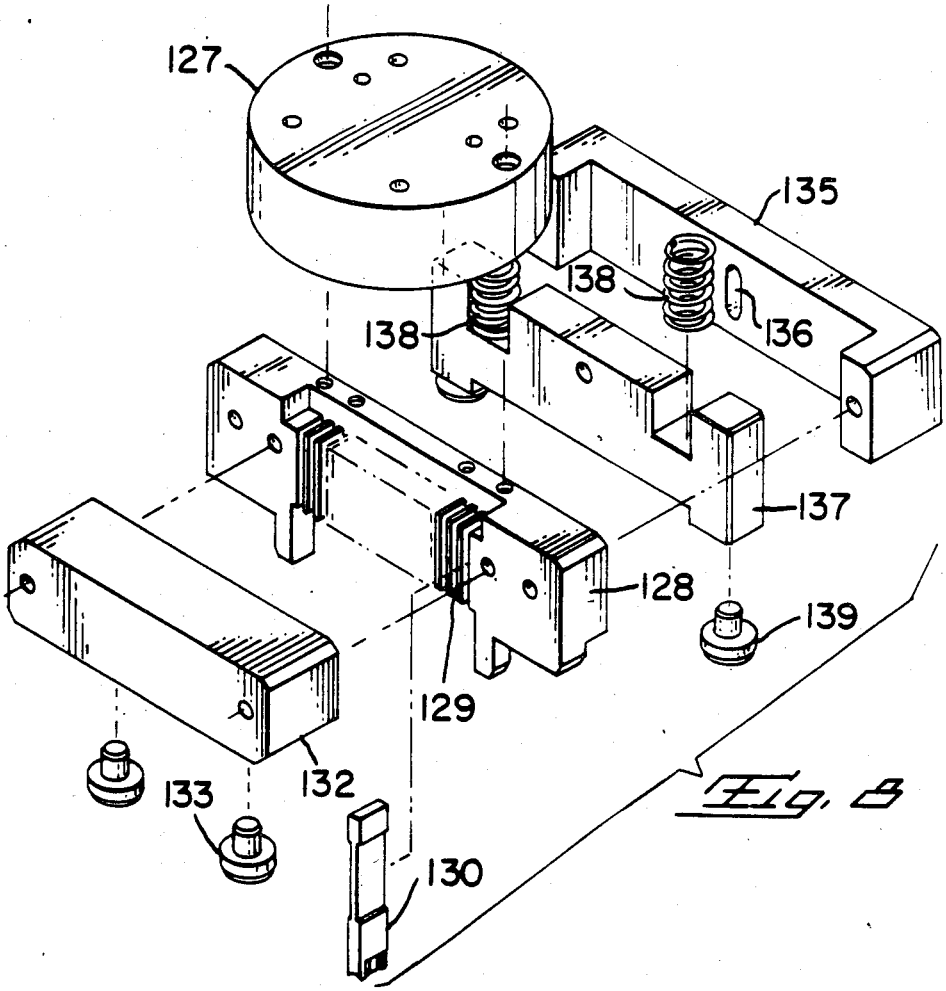
FIG. 8 is an exploded perspective of the upper tooling package.

Referring to FIGS. 7 and 8, the upper tooling package 125 comprises a mounting block 127 to which inserter support 128 is fixed. The support 128 has slots 129 which closely receive inserters 130 having wire insertion ends generally as shown in U.S. Pat. No. 4,385,794. The inserters are held in place by cover block 132 fixed to support 128, the block 132 having bumpers 133 fixed on the underside. A ram guide 135 fixed oppositely on support 128 has a slot 136 to limit downward movement of ram 137, which is urged downward by springs 138.

Figure 9:
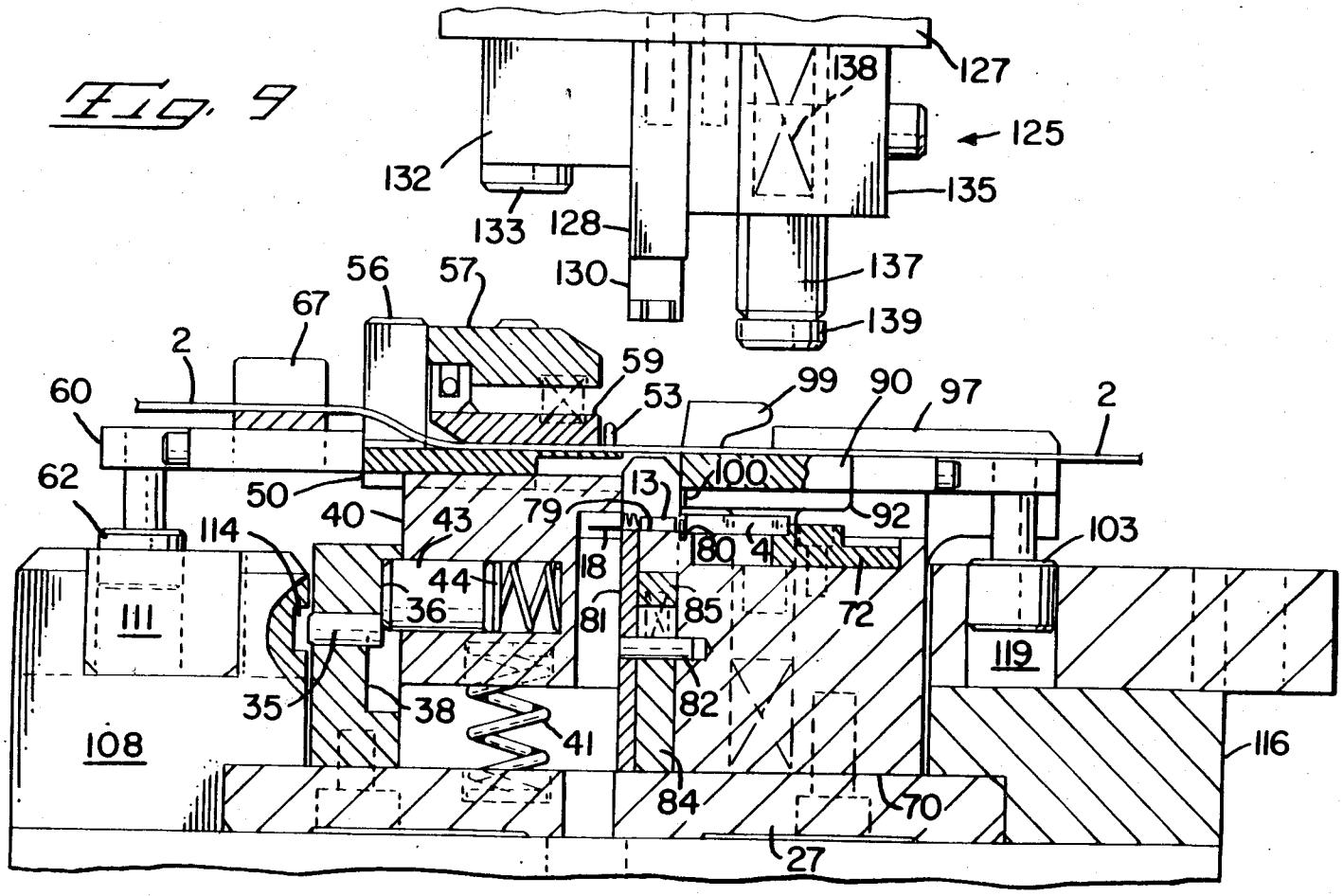
FIG. 9, 10, 11, and 12 are end section views of the tooling during the operating sequence.

FIG. 9 is an end section view corresponding to the plan view of FIG. 6, and depicts the lower tooling at the termination station prior to the descent of ram 137. A connector housing 4 is seated on housing support 70 between rear rail 72 and ledge 80. Conductor receiving portions 13 of terminals sit on the slotted terminal support portion 79 of the anvil, which further comprises the carrier shear portion 81. The organizer 85 is fully loaded upward so that partitions 87 (FIG. 4C) fit closely between portions 13. The wires 2 pass through snap-in comb 67, first comb 53, and second comb 99. A plate 59 is spring loaded against clamp arm 57 to clamp the wires in channels 52 (FIG. 4B) beneath bumpers 133 on cover plate 132. The wires 2 are aligned directly between respective inserters 130 and conductor receiving portions 13. The shear bar 90 is positioned on spring loaded pedestals 92 beneath bumpers 139 on spring loaded ram 137, the die surfaces 100 extending beyond housing 4 to align vertically with respective tines 12 (FIG. 2A). The detent 43 remains spring loaded against the bottom of shallow slot 36 in shear guide 32, so that there is no force urging release pin 35 into channel 114.

Referring to FIG. 10, the upper tooling 125 is shown fully descended. during the downstroke, the plug 139 forces the shear bar 90 down so the dies 100 crimp tines 12 (FIG. 2A) as pedestal 92 descends to compress spring 93. The plug 133 bears on clamp arm 57 to force carrier shear 40 downward to sever strip 18 against anvil shear portion 81, compressing spring 41. Inserters 130 shear wires 2 against shear bar 90, and ram 137 recedes into guide 135 to compress spring 138. In the final stage of downward motion, the inserters 130 stuff the wires 2 into the conductor receiving portions 13 of terminals 10, and likewise form tines 17 onto the insulation (FIG. 2B). The detent 38 snaps into pocket 38, forcing pin 35 into channel 114. This prevents upward movement of shear 40 when tooling 125 ascends, so that the loader 50 will remain aligned with the terminals as shown.

Figure 11:
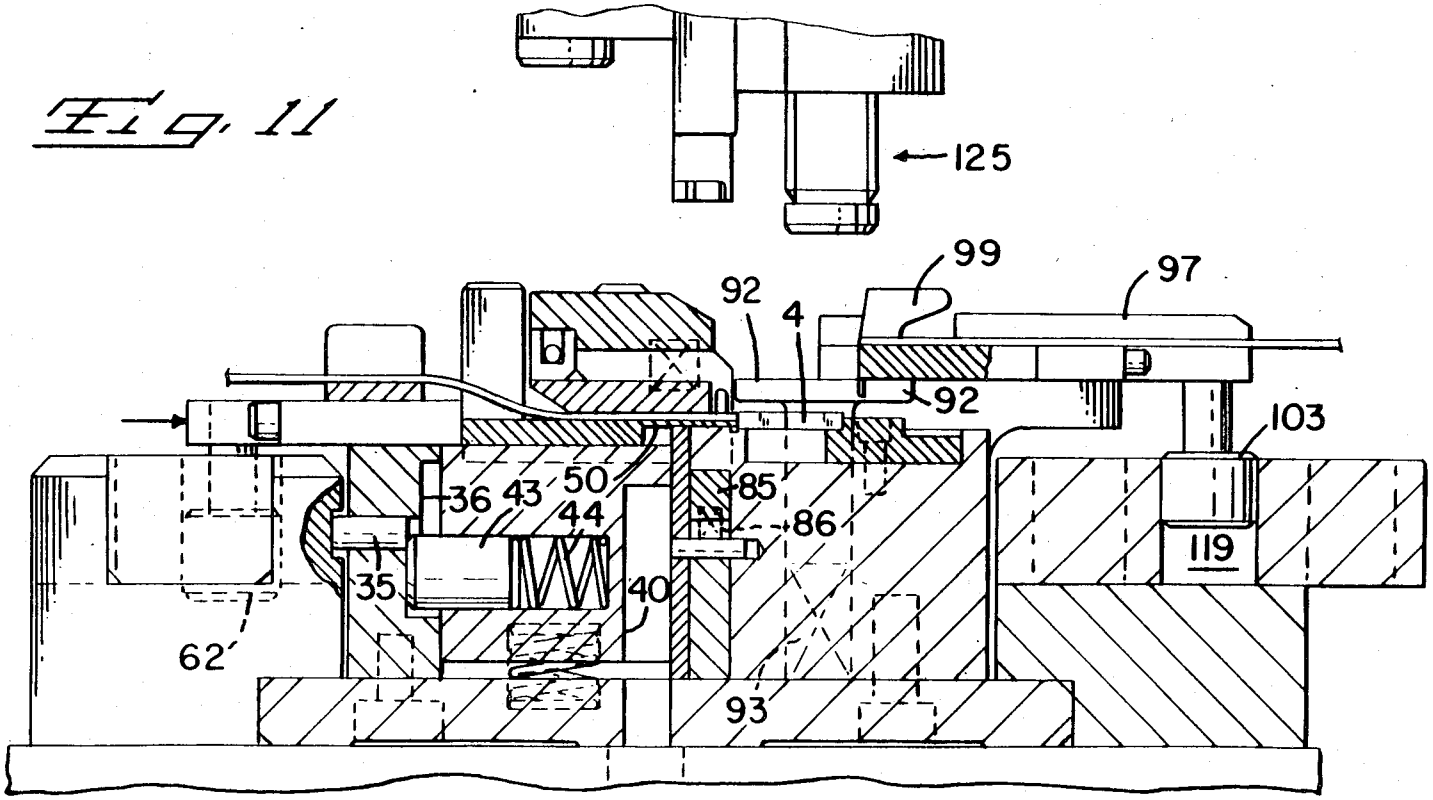

FIG. 11 shows the lower tooling on the return stroke, at the point when follower 62 is at the inward most part of cam track 111, pushing the loader 50 inward so that end surfaces 54 (FIG. 4B) bear on terminals 10 to fully load same into housing 4 (FIG. 2C). As the loader 50 moves over terminal support platform 79, the partitions 87 (FIG. 4C) are forced downward as the organizer 85 compresses spring 86.

Figure 12:
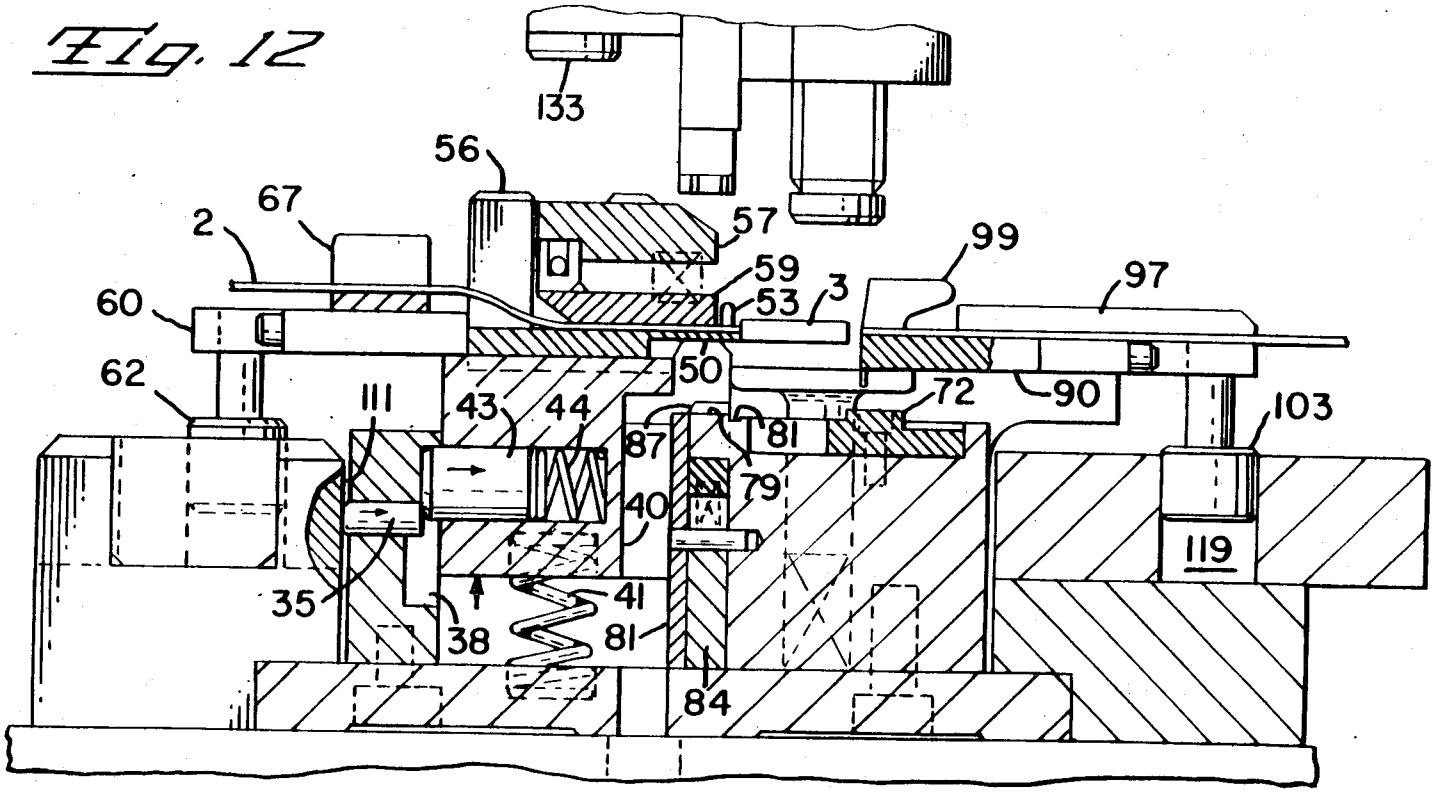

Referring to FIG. 12, continued return movement of the lower tooling package 25 causes release pin 35 to ride out of channel 114 on left cam block 111, so that detent 43 is released from pocket 38. This permits carrier shear block 40 to "pop up" under the action of spring 41. The fully terminated connector 3 also pops up with the wires 2 clamped to loader 50, permitting easy access for removing the connector 3. Another preloaded housing may then be emplaced for termination and the completed connector drawn rightward, the trailing wires being drawn from respective reels and aligned in combs 53, 99 for the next cycle of the apparatus.

While the example in the above description employs discrete insulated wires, a ribbon-type cable with strips of insulation between the conductors could also be terminated by punching out sections of the strips as necessary to receive the conductors in the wire combs.

I claim:

1. Apparatus for mass terminating conductors to an electrical connector of the type comprising a housing preloaded with a plurality of terminals connected to a carrier strip, each terminal having a conductor receiving portion exposed from the housing, comprising:

a press having a ram and an upper tooling package aligned above a termination station, said upper tooling package being vertically movable by means of the ram towards and away from the terminating station, a lower tooling package movable to and from said termination station, said lower package comprising housing support means, anvil means which support the exposed conductor receiving portions of the terminal, a shear cooperable with said anvil means to shear said carrier strip on descent of said ram, and terminal loading means above said shear, said terminal loading means being vertically aligned with said terminals by descent of said upper tooling package, and means for advancing said terminal loading means toward said housing support means to load said terminals into said housing during movement of said lower tooling package from said termination station.

2. Apparatus as in claim 1 wherein said means for advancing said terminal loading means comprises a cam track fixed with respect to said termination station and a follower fixed with respect to said loading means and riding in said track.

3. Apparatus as in claim 1 further comprising spring loaded detent means in said lower tooling package and a channel fixed with respect to said termination station said channel extending in the direction of movement of the upper tooling package, said detent means engaging in said channel to keep said loading means vertically aligned with said terminals on ascent of said ram, said detent means being released from said channel after said terminals are loaded during movement of said lower tooling package from said termination station.

4. Apparatus as in claim 1 wherein said loading means is integral with a first comb which keeps the conductors aligned with the conductor receiving portions of the terminals during descent of the ram.

5. Apparatus as in claim 1 further comprising a conductor shear bar in said lower tooling package, said shear bar being cooperable with said upper tooling package to shear said conductors adjacent the conductor receiving portions of the terminals on descent of said ram, means for advancing said shear bar from a position adjacent said housing support to a position over said support during movement of said lower tooling package to said termination station.

6. Apparatus as in claim 5 wherein said means for advancing said shear bar comprises a cam track fixed with respect to said termination station and a follower fixed with respect to said shear bar and riding in said track.

7. Apparatus as in claim 5 wherein said shear bar is integral with a second comb which keeps the conductors aligned with the conductor receiving portions of the terminals during descent of the ram.

8. Apparatus as in claim 7 wherein said loading means is integral with a first comb which is aligned with the second comb, said first and second combs keeping said conductors aligned with the exposed conductor receiving portions of the terminals during descent of the ram.

9. Apparatus as in claim 5 wherein said shear bar extends slightly beyond said housing support means to overlap said anvil means when said tooling is at said termination station, a portion of said shear bar facing the anvil means having die surfaced spaced as said terminals and profiled to form tines upstanding therefrom toward the anvil means, said shear bar descending to so form said tines on descent of said ram.

10. Apparatus as in claim 1 wherein said anvil means is interrupted by partitions spaced to closely receive the conductor receiving portions of the terminals therebetween to provide lateral support during insertion of conductors into said portions, said partitions retreating into said anvil means during advance of said terminal loading means toward said housing.

11. Apparatus for mass terminating conductors to an electrical connector of the type comprising a housing preloaded with a plurality of terminals connected to a carrier strip, each terminal having a conductor receiving portion exposed from the housing, the apparatus being of the type comprising a press having a vertically movable upper tooling package aligned above a termination station, housing support means and anvil means movable on a linear path to and from said termination station, and a shear cooperable with said anvil means to shear said carrier strip on descent of said upper tooling package, said anvil means supporting the exposed conductor receiving portions of the terminals, characterized in that said shear, said housing support and said anvil are part of a lower tooling package movable as a unit to and from said termination station, said lower tooling package further comprising terminal loading means above said shear, said terminal loading means being aligned with said terminals by descent of said ram, said apparatus further comprising means for moving said terminal loading means toward said housing support means to load said terminals into said housing during movement of said lower tooling package from said termination station.

* * * * *